US007516949B2

(12) United States Patent
Tunink et al.

(10) Patent No.: US 7,516,949 B2
(45) Date of Patent: Apr. 14, 2009

(54) SIDEWAYS SHEET FEEDER AND METHODS

(75) Inventors: Corey D. Tunink, La Vista, NE (US); Timothy J. Walpus, Omaha, NE (US); Jon A. Gates, Honey Creek, IA (US); Ray Stuck, Omaha, NE (US)

(73) Assignee: First Data Corporation, Greenwood Village, CO (US)

( * ) Notice: Subject to any disclaimer, the term of this patent is extended or adjusted under 35 U.S.C. 154(b) by 321 days.

(21) Appl. No.: 11/202,434

(22) Filed: Aug. 10, 2005

(65) Prior Publication Data

US 2007/0035077 A1 Feb. 15, 2007

(51) Int. Cl.
*B65H 5/00* (2006.01)

(52) U.S. Cl. ..... 270/52.02; 270/52.14; 270/52.15; 270/52.16; 270/58.02; 270/58.03; 270/52.06

(58) Field of Classification Search ..... 270/52.02, 270/52.14, 52.15, 52.16, 58.02, 58.03, 52.06
See application file for complete search history.

(56) References Cited

U.S. PATENT DOCUMENTS

| | | | | |
|---|---|---|---|---|
| 2,542,089 | A | | 2/1951 | Leifer |
| 2,821,384 | A | | 1/1958 | Mendes |
| 3,049,845 | A | | 8/1962 | Hanson |
| 3,409,149 | A | | 11/1968 | Graux |
| 3,773,394 | A | | 11/1973 | Giovannini |
| 3,881,719 | A | | 5/1975 | Schmermund |
| 3,905,593 | A | | 9/1975 | Behn |
| 4,083,551 | A | | 4/1978 | St. Denis |
| 4,323,230 | A | | 4/1982 | Rising |
| 4,402,498 | A | | 9/1983 | Muller |
| 4,462,745 | A | | 7/1984 | Johnson et al. |
| 4,509,735 | A | | 4/1985 | Kosner |
| 4,513,956 | A | | 4/1985 | Sigvardt et al. |
| 4,544,146 | A | | 10/1985 | Zemke et al. |
| 4,643,705 | A | | 2/1987 | Bober |
| 4,800,505 | A | | 1/1989 | Axelrod et al. |
| 4,883,264 | A | | 11/1989 | Yoshikawa et al. |
| 4,905,977 | A | | 3/1990 | Vijuk |
| 4,921,237 | A | | 5/1990 | Nubson et al. |
| 4,978,416 | A | | 12/1990 | Potter et al. |
| 5,039,077 | A | * | 8/1991 | Gunther, Jr. ..... 270/52.02 |
| 5,067,088 | A | * | 11/1991 | Schneiderhan ..... 700/221 |
| 5,076,556 | A | | 12/1991 | Mandel |
| 5,125,635 | A | | 6/1992 | Iwabuchi |
| 5,127,640 | A | | 7/1992 | Orsinger et al. |

(Continued)

*Primary Examiner*—Gene Crawford
*Assistant Examiner*—Leslie A Nicholson, III
(74) *Attorney, Agent, or Firm*—Townsend and Townsend and Crew LLP

(57) ABSTRACT

Sheet processing systems and methods are provided, including systems and methods for advancing and organizing sheets. System can include an alignment mechanism having an alignment plate, a first advancing mechanism configured to individually advance each sheet of a series of sheets in a first direction from a lower feeder to the alignment mechanism, a second advancing mechanism configured to individually advance each sheet of the series of sheets in a second direction from the alignment mechanism to an accumulator, such that the second direction is substantially perpendicular to the first direction, a sensor configured to read an identification code of each sheet of the series of sheets, and a processor configured to control operation of the first and second advancing mechanisms based on sensor readings of the identification codes.

20 Claims, 12 Drawing Sheets

U.S. PATENT DOCUMENTS

| | | | | | |
|---|---|---|---|---|---|
| 5,196,083 | A | | 3/1993 | Baker et al. | |
| RE34,483 | E | | 12/1993 | Bowman et al. | |
| 5,317,654 | A | | 5/1994 | Perry et al. | |
| 5,327,701 | A | | 7/1994 | Dronsfield | |
| 5,458,323 | A | * | 10/1995 | Magee et al. | 270/52.02 |
| 5,499,806 | A | | 3/1996 | Bourg | |
| 5,556,086 | A | | 9/1996 | Munneke et al. | |
| 5,647,583 | A | | 7/1997 | Emigh et al. | |
| 5,667,210 | A | | 9/1997 | DeLise, Jr. | |
| 5,704,602 | A | | 1/1998 | Taylor et al. | |
| 5,704,607 | A | | 1/1998 | Brotherston | |
| 5,709,374 | A | | 1/1998 | Taylor et al. | |
| 5,754,434 | A | | 5/1998 | Delfer et al. | |
| 5,772,194 | A | | 6/1998 | Huebler et al. | |
| 5,823,521 | A | | 10/1998 | Emigh et al. | |
| 5,836,580 | A | | 11/1998 | Hansen et al. | |
| 5,941,516 | A | | 8/1999 | Emigh et al. | |
| 5,975,514 | A | | 11/1999 | Emigh et al. | |
| 5,992,838 | A | * | 11/1999 | Saitoh | 270/58.09 |
| 6,000,693 | A | | 12/1999 | Tranquilla | |
| 6,074,332 | A | | 6/2000 | Helmstadter et al. | |
| 6,094,894 | A | | 8/2000 | Yates | |
| 6,135,292 | A | | 10/2000 | Pettner | |
| 6,164,043 | A | | 12/2000 | Miller et al. | |
| 6,202,005 | B1 | | 3/2001 | Mahaffey | |
| 6,257,566 | B1 | * | 7/2001 | Dooley | 270/52.18 |
| 6,273,411 | B1 | | 8/2001 | Vijuk | |
| 6,276,677 | B1 | | 8/2001 | Hommochi et al. | |
| 6,309,336 | B1 | | 10/2001 | Muessig et al. | |
| 6,349,242 | B2 | | 2/2002 | Mahaffey | |
| 6,481,704 | B1 | | 11/2002 | Koster et al. | |
| 6,623,415 | B2 | | 9/2003 | Gates et al. | |
| 6,669,186 | B2 | | 12/2003 | Tunink et al. | |
| 6,670,569 | B2 | | 12/2003 | Smith et al. | |
| 6,679,489 | B2 | | 1/2004 | Casto et al. | |
| 6,776,412 | B2 | * | 8/2004 | DaCunha et al. | 271/274 |
| 6,802,500 | B2 | | 10/2004 | Bennett et al. | |
| 2002/0145245 | A1 | | 10/2002 | Casto et al. | |
| 2003/0112479 | A1 | * | 6/2003 | Huber et al. | 358/498 |
| 2006/0233432 | A1 | * | 10/2006 | Ishida et al. | 382/141 |

* cited by examiner

SIDEWAYS SHEET FEEDER AND METHODS

CROSS-REFERENCES TO RELATED APPLICATIONS

This application is related to U.S. Pat. No. 6,802,500, entitled "Systems And Methods Of Providing Inserts Into Envelopes," issued Oct. 12, 2004; U.S. Pat. No. 6,670,569, entitled "Mail Handling Equipment And Methods," issued Dec. 30, 2003; U.S. Pat. No. 6,623,415, entitled "Sheet Folding Systems And Methods," issued Sep. 23, 2003; and U.S. patent application Ser. No. 10/718,285, entitled "Multiple Insert Delivery Systems and Methods," filed Nov. 19, 2003; each of which is assigned to the assignee of the present application and each of which is incorporated herein by reference.

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

The present invention relates generally to the field of sheet processing systems and methods, and more particularly, to systems and methods for aligning and organizing sheets, such as paper statements, inserts, financial documents, and the like.

Financial institutions, long distance telephone companies, and a number of other organizations frequently send paperwork to existing or potential customers. For example, a credit card customer may receive monthly statements, informational inserts, sheets of convenience checks, and the like. In some circumstances, the paperwork accompanies a card, such as a credit card or the like, mounted in or to a card carrier. In order to send the paperwork and/or card to a customer, the information may be sent first to a third party organization for processing and mailing. One such organization is First Data Merchant Services Corporation (FDMS).

Mail processing systems are currently used to mail, for example, a sheet of convenience checks to a customer. Current systems typically will print the checks on an individual sheet of paper, stack large numbers of sheets in a bin, individually retrieve each sheet, and then process the sheet for eventual delivery to the customer. The high volume of mailings, however, can make this an expensive process. Moreover, current systems may be incapable of processing different batches of sheets, where the location of bar codes on the sheets vary from one batch to another.

The present invention relates to machines and techniques that address at least some of the problems of the current processing equipment. For example, the present invention provides machines and techniques that may be used to process such media in a more cost efficient manner.

BRIEF SUMMARY OF THE INVENTION

In a first aspect, the present invention provides a method for processing a series of sheets. The method includes advancing a first sheet in a first direction to an alignment mechanism, reading a first identification code of the first sheet, advancing the first sheet in a second direction to an accumulator, wherein the second direction is substantially perpendicular to the first direction, advancing a second sheet in the first direction to the alignment mechanism, reading a second identification code of the second sheet, and comparing the first identification code with the second identification code. In some aspects, the method includes advancing the second sheet in the second direction to match with the first sheet in the accumulator, if the second identification code corresponds with the first identification code. In a related aspect, the step of advancing each sheet to the alignment mechanism can include aligning the sheet with an alignment plate of the alignment mechanism. Similarly, the step of advancing each sheet to the alignment mechanism can include advancing a bottom sheet of a sheet stack to the alignment mechanism. The step of advancing each sheet to the alignment mechanism can also include verifying that a single sheet at a time is advanced to the alignment mechanism. In some aspects, the step of advancing each sheet to the alignment mechanism may include verifying that each sheet is fully advanced to the alignment mechanism and is aligned within the alignment mechanism. Optionally, advancing each sheet to the accumulator can include contacting each sheet with a friction wheel, which may be in operative association with a rotary solenoid. In some cases, the identification code of one or more sheets includes a bar code. Relatedly, the identification code can include a set number identifier and a sequence number identifier. In further aspects, the step of reading the identification code may include scanning the identification code with a laser scanner.

In another aspect, the present invention provides a system for processing a series of sheets. The system can include an alignment mechanism comprising an alignment plate, a first advancing mechanism that is configured to individually advance each sheet of the series of sheets in a first direction from a lower feeder to the alignment mechanism, a second advancing mechanism that is configured to individually advance each sheet of the series of sheets in a second direction from the alignment mechanism to an accumulator, wherein the second direction is substantially perpendicular to the first direction, a sensor that is configured to read an identification code of each sheet of the series of sheets, and a processor configured to control operation of the first and second advancing mechanisms based on sensor readings of the identification codes. In some aspects, the alignment mechanism can include an alignment plate. In further aspects, the system may include a count sensor configured to verify that a single sheet at a time is advanced to the alignment mechanism. In still further aspects, the system can include an orientation sensor configured to verify that each sheet is fully advanced to the alignment mechanism and is aligned within the alignment mechanism. Optionally, the second advancing mechanism can include a friction wheel adapted to contact a sheet disposed in the alignment mechanism upon instructions from the processor. The friction wheel may be in operative association with a rotary solenoid. In some aspects, the sensor can include a laser scanner.

In another aspect, the present invention provides a computer program product for processing a series of sheets. The program product can include code for advancing a first sheet in a first direction to an alignment mechanism, code for reading a first identification code of the first sheet, code for advancing the first sheet in a second direction to an accumulator, wherein the second direction is substantially perpendicular to the first direction, code for advancing a second sheet in the first direction to the alignment mechanism, code for reading a second identification code of the second sheet, code for comparing the first identification code with the second identification code, and a computer-readable medium for storing the codes. In some aspects, the computer program product may also include code for advancing the second sheet in the second direction to match with the first sheet in the accumulator, if the second identification code corresponds with the first identification code.

DETAILED DESCRIPTION OF THE INVENTION

The present invention provides systems and methods for advancing and organizing sheets, such as improved alignment techniques that allow for efficient sheet processing. For example, a system of the present invention can advance a sheet in a first direction from a feeder to an alignment mechanism, and then advance the sheet in a second direction from the alignment mechanism to an accumulator, such that the first direction is substantially perpendicular to the second direction. Such alignment approaches provide several benefits. As the sheet is fed into the alignment mechanism, it can be advanced against an alignment member, thereby placing the sheet in a desired orientation. The operator can therefore be assured that the sheet is appropriately aligned when it is advanced from the alignment mechanism to an accumulator or to some other downstream processing station.

Often, such systems will include a sensing apparatus for reading bar codes or other indicia on the sheet. Advantageously, the system can be configured such that such a sensing step is carried out when the sheet is in the desired position, after the alignment step is completed. This feature can help to ensure an accurate reading of the bar code, because the sheet is stationary and properly aligned.

Relatedly, the present invention provides systems and methods where the position of the sensing apparatus can be easily adjusted, in order to accurately read bar codes or other indicia from sheets as they are advanced through the system. Such adjustability is convenient when processing sheets from different batches, where the location of the bar code on the sheet may vary from one batch to another. It will be appreciated that such adjustability also provides for the accurate processing of sheets where the orientation of the indicia varies from one batch to another. The system can also be adjusted to sense indicia that are located on the top of the sheet, or on the bottom of the sheet.

Figure 1:
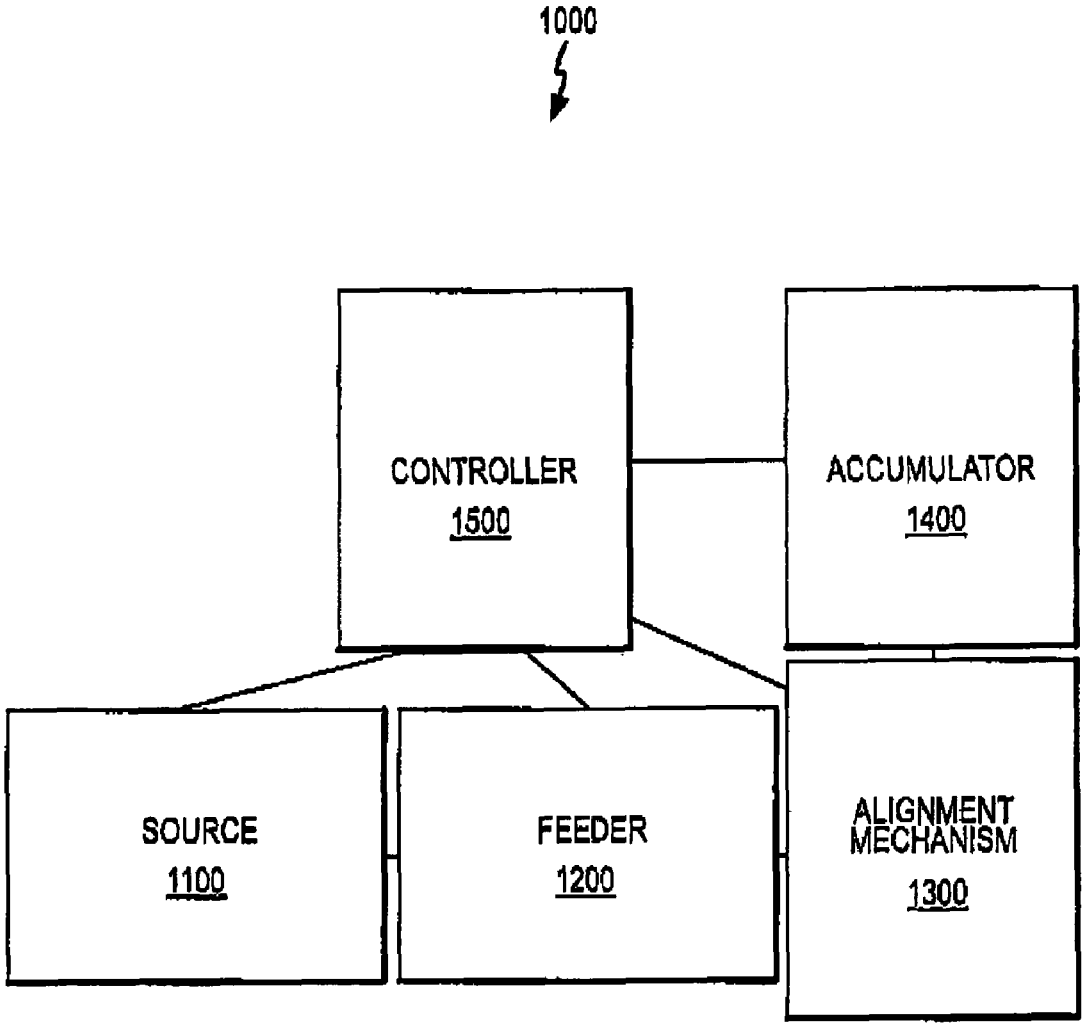
FIG. 1 provides a schematic representation of a sheet processing system according to one embodiment of the present invention.

FIG. 1 depicts a simplified schematic of a sheet processing system 1000 according to one embodiment of the present invention. System 1000 can include a series of stations adapted to process a sheet or a set of sheets for any of a variety of downstream processing steps, such as for folding or for insertion into an envelope for mailing. Documents or sheets processed by system 1000 can include one or more sheets of paper, such as a customer billing statement, a new cardholder agreement, convenience checks, and the like. Documents may also include any of a variety of paper inserts, such as advertisements and the like.

Turning now to FIG. 1, one embodiment of sheet processing system 1000 according to the present invention will be described. System 1000 can include a paper source 1100 and a feeder 1200 for holding sheets and for delivering sheets for downstream processing. In some cases, feeder 1200 can include, or be adapted for receiving paper from, paper source 1100, which may include or be coupled with a printer (not shown) for printing customer documents, bank statements, and the like. The printer may print, for example, alphanumeric characters to identify a customer, a customer's address, a customer's billing information, and the like. The printer further may print bar codes and other identifying marks on the documents. In one embodiment, paper source is a continuous form paper source. In this manner, paper source provides for the continuous printing of statements, convenience checks or the like for multiple customers. System 1000 can also include an alignment mechanism 1300 and an accumulator 1400. System 1000 can be controlled by controller 1500 via various modes of operative association.

Figure 2:
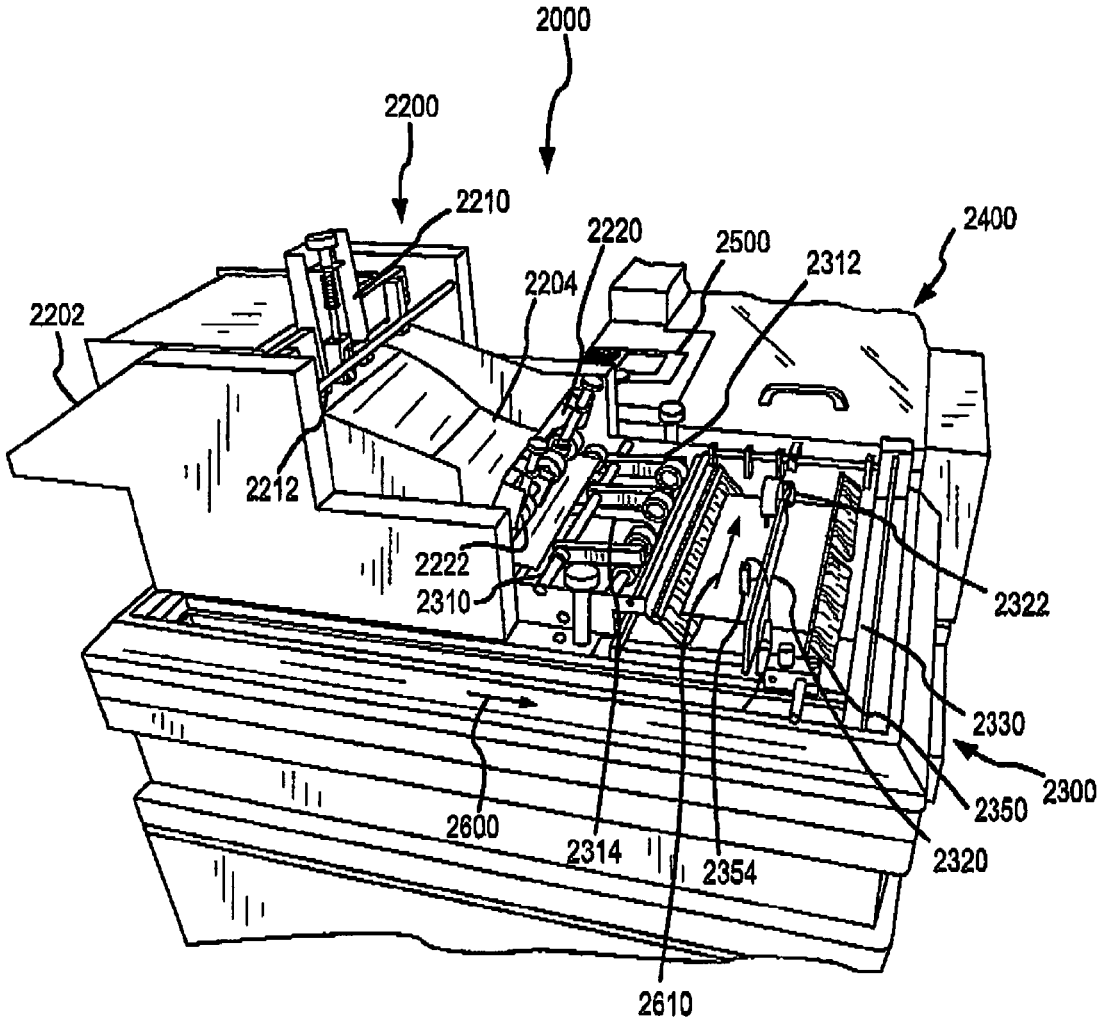
FIG. 2 shows a perspective view of a sheet processing system according to one embodiment of the present invention.

FIG. 2 show sheet processing system 2000 according to one embodiment of the present invention. An operator can control system 2000 via a computer 2500. Feeder 2200 can include an upper feeder tray 2202 and a lower feeder tray 2204. Feeder 2200 may also include an upper advancing mechanism 2210 or similar conveying means for advancing one or more sheets from upper feeder tray 2202 toward lower feeder tray 2204. Often, upper advancing mechanism 2210 includes a plurality of upper rollers 2212 and a plurality of upper belts (see FIG. 6) which are configured to grasp one or more sheets from a stack of sheets disposed on upper feeder tray 2202, and advance the sheet or sheets toward lower feeder tray 2204. Optionally, upper rollers 2212 and upper belts may be configured to grasp a bottom-most sheet or set of sheets from the stack of sheets disposed on upper feeder tray 2202. This may be accomplished with the assistance of a vacuum finger or similar grasping means. In some embodiments, a bundle of sheets from the stack can be conveyed from upper feeder tray 2202 to lower feeder tray 2204. Typically, such sheet advancing or conveying actions are completed in response to a signal as provided by computer 2500.

Feeder 2200 may further include a lower advancing mechanism 2220 or similar conveying means for advancing one or more sheets from lower feeder tray 2204 toward a downstream processing location. For example, lower advancing mechanism 2220 may include a plurality of lower rollers 2222 and a plurality of lower belts (see FIG. 7) which are configured to grasp one or more sheets from a stack of sheets disposed on lower feeder tray 2204, and advance the sheet or sheets toward alignment mechanism 2300. In some cases, lower rollers 2222 are configured to grasp a bottom-most sheet or set of sheets from the stack of sheets disposed on lower feeder tray 2204. This may be accomplished with the assistance of a vacuum finger or similar grasping means. Although it is appreciated that a single sheet, or optionally multiple sheets, can be processed at a time through alignment mechanism 2300, to avoid prolixity the following describes the processing of a single sheet at a time.

In the embodiment shown in FIG. 2, alignment mechanism 2300 can include a first advancing mechanism 2310 and a second advancing mechanism 2320. Typically, first advancing mechanism 2310 includes one or more first rollers 2312 and one or more first belts 2314 which are configured to grasp one a sheet as it is advanced from lower rollers 2222 and lower belts (see FIG. 7), and further advance the sheet in direction 2600 toward an alignment member 2330 to adopt an aligned orientation. In some embodiments, alignment mechanism 2300 will include one or more sheet supports (see FIG. 8) upon which sheet may rest, and alignment member 2330 will include an alignment plate. The sheet can be registered against alignment member 2330 to facilitate proper alignment for various purposes, which are further discussed below. The present invention contemplates any of a variety of approaches for aligning the sheet as desired. For example, in one embodiment, the sheet is urged in direction 2600 such that an advancing edge of the sheet is set flush against alignment member 2330. It is appreciated that such alignment schemes can provide reproducible results for consistently aligning each sheet in a desired orientation. What is more, alignment member 2330 and other components of advancing mechanism 2300 may be adjusted or controlled according to the specific needs of the operator. Second advancing mechanism 2320 can include an orientation sensor 2354 configured to determine or verify whether the sheet is advanced completely into alignment mechanism and oriented therein as desired. In some embodiments, orientation sensor 2534 may also include a count sensor for verifying that a single sheet at a time is advanced against alignment member 2330. Typically, alignment mechanism 2300 will also include a sheet information sensor (see FIG. 8) for reading certain bar codes or other indicia present on the sheet.

In one embodiment, a sheet is fed into alignment mechanism 2300 and advanced against alignment member 2330 to place the sheet in a desired orientation, and orientation sensor 2354 can confirm the sheet orientation. Sheet information sensor can then read a bar code that is printed on the sheet, and system 2300 can further process this sheet, or other sheets in the system, based on the sheet information sensor reading.

Second advancing mechanism 2320 can also include one or more second rollers 2322 which are configured to grasp the sheet from its position at alignment member 2330 and advance the sheet in direction 2610 toward accumulator 2400. In some embodiments, second advancing mechanism can further include a rotary solenoid 3322 and a support bar 3328. In the embodiment shown here, second roller 3322 is continuously rotating during operation of system 3000. The default for roller 3322 is in a raised position, so that sheets can advance freely from lower feeder tray 3204 to alignment mechanism 3300. Rotary solenoid 3326 can be configured to control an up and down movement of second roller 3322. When system 3000 determines that a sheet should be conveyed from alignment mechanism 3000 toward accumulator 3400, rotary solenoid 3326 may effect a downward movement of second roller 3322. Subsequently, second roller 3322 contacts the sheet and impels the sheet toward accumulator 3400.

In the present embodiment, direction 2600 is substantially perpendicular to direction 2610. In other words, alignment mechanism 2300 can be configured such that system 2000 has an approximate ninety degree (90°) turn for sheets processed therethrough. In this manner, system 2000 can maintain a small footprint. The ninety degree turn also can help align the sheet for certain operations to be performed on the sheet while it is disposed at alignment mechanism 2300. For example, the sheet may be subjected to certain sensing procedures which require or are facilitated by the alignment. Similarly, such alignment may further prepare the sheet for additional downstream processing steps. Brush 2350 can further assist in the alignment of the sheet by preventing or inhibiting the sheet from lifting off of alignment mechanism 2300 or from unwanted transverse movement on alignment mechanism 2300.

Figure 3:
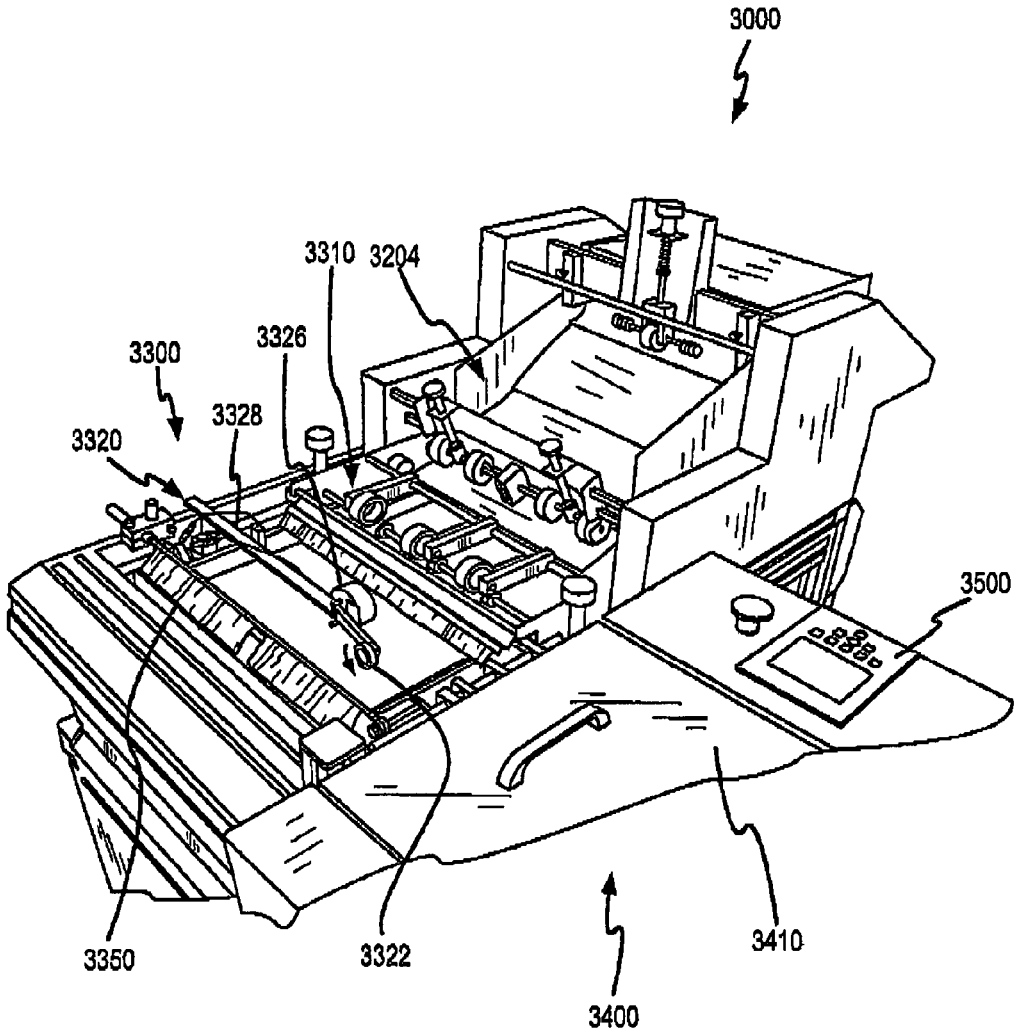
FIG. 3 shows a perspective view of a sheet processing system according to one embodiment of the present invention.

FIG. 3 shows a processing system 3000 according to one embodiment of the present invention. System 3000 can include a central computer 3500 for controlling its operations. As noted above, the present invention provides for systems that can match a first sheet with a second sheet based on specified criteria. For example, in some embodiments, a first sheet with a card can be matched with a second sheet based on bar codes that are imprinted on the sheets. A first advancing mechanism 3310 can convey a first sheet from lower feeder tray 3204 to alignment mechanism 3300, and a bar code of the first sheet can be scanned by a sheet information sensor (see FIG. 8). Second advancing mechanism 3320 can then convey first sheet to accumulator 3400. Subsequently, first advancing mechanism 3310 can convey a second sheet from lower feeder tray 3204 to alignment mechanism 3300, and its bar code can be scanned. If the bar codes from the first and second sheets indicate a match, then the second sheet can be advanced to be placed with the first sheet in the accumulator 3400. Accumulator 3400 can include a translucent lid 3410 that allows visual access to folder accumulator 3400 when lid 3410 is closed during system 4000 operation.

The first and second sheets can then be prepared for other downstream processing steps. For example, they may be conveyed to a folding section (not shown) where they are folded, and to an envelope stuffing section (not shown) where they are placed in an envelope. The envelope can then be sealed and inserted into a postage meter where it is stamped with the appropriate postage. The envelope is then ready for mailing.

Figure 4:
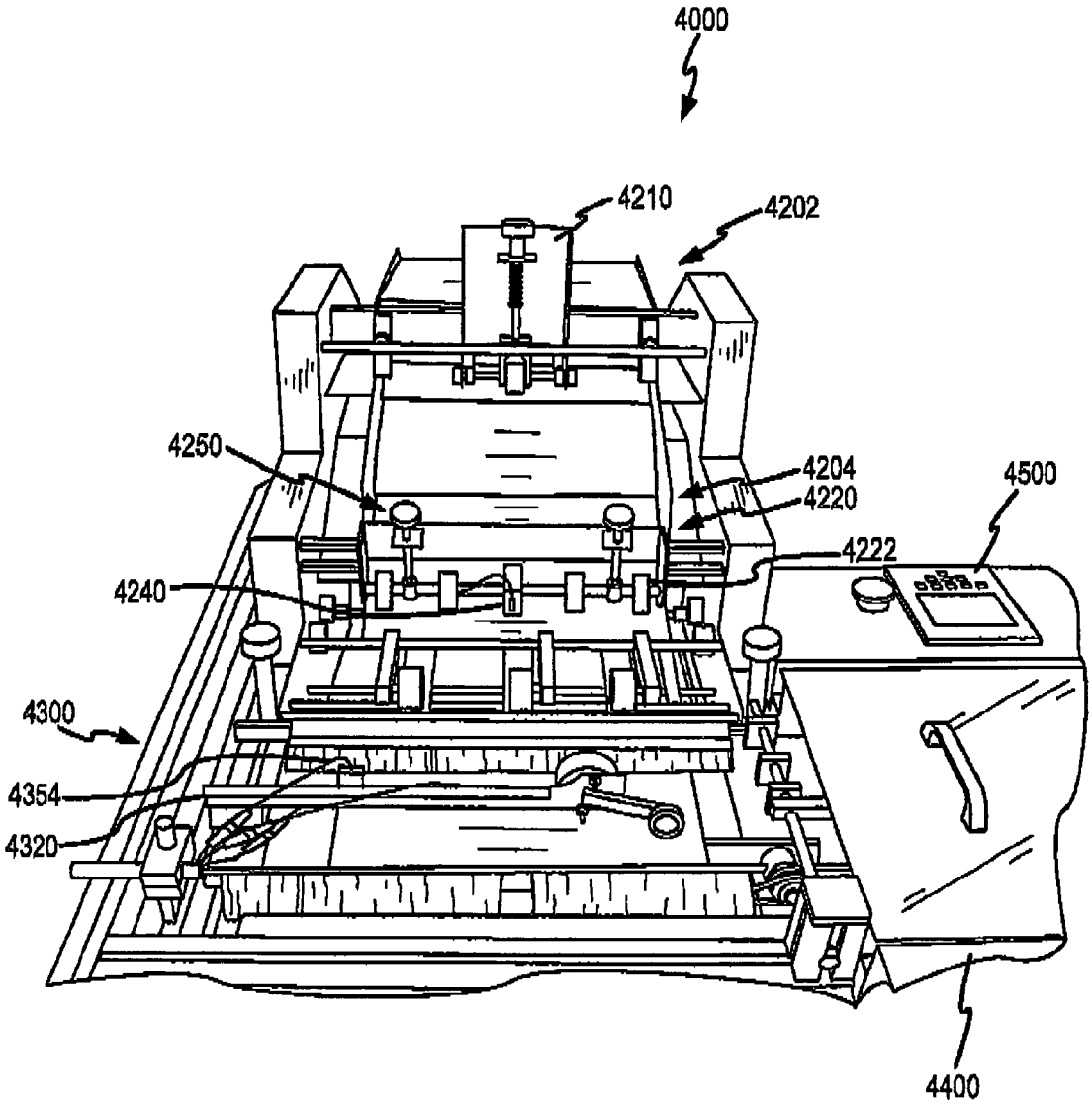
FIG. 4 shows a perspective view of a sheet processing system according to one embodiment of the present invention.

FIG. 4 shows a processing system 4000 according to one embodiment of the present invention. A stack of first sheets rests upon upper feeder tray 4202, and upper advancing mechanism 4210 can advance a batch of sheets from the bottom-most portion of the stack of first sheets down to lower feeder tray 4204. From there, lower advancing mechanism 4220 can advance a single bottom-most sheet from the batch of sheets on lower feeder tray 4204 to alignment mechanism 4300. Lower advancing mechanism 4220 can include a count sensor 4240 that is configured to determine how many sheets are present in lower feeder tray 4204. In some embodiments, batch sensor 4240 includes a reflective sensor. If system 4000 determines that an insufficient number of sheets are present in lower feeder tray 4204, system 4000 may instruct upper advancing mechanism 4210 to convey additional sheets from upper feeder tray 4202 to lower feeder tray 4204.

Lower advancing mechanism 4220 may further include one or more adjustment knobs 4250, which may be used by a system operator to adjust the setting of lower rollers 4222. For example, lower rollers 4222 can be adjusted such that only one sheet at a time is advanced from lower feeder tray 4204 toward alignment mechanism 4300. Second advancing mechanism 4320 can include an orientation sensor 4354 which can be configured to determine whether sheet is advanced completely into alignment mechanism and oriented therein as desired. It is appreciated that the position of orientation sensor 4354 can be adjusted as desired, so that it can effectively confirm the position and orientation of the sheet.

Figure 8:
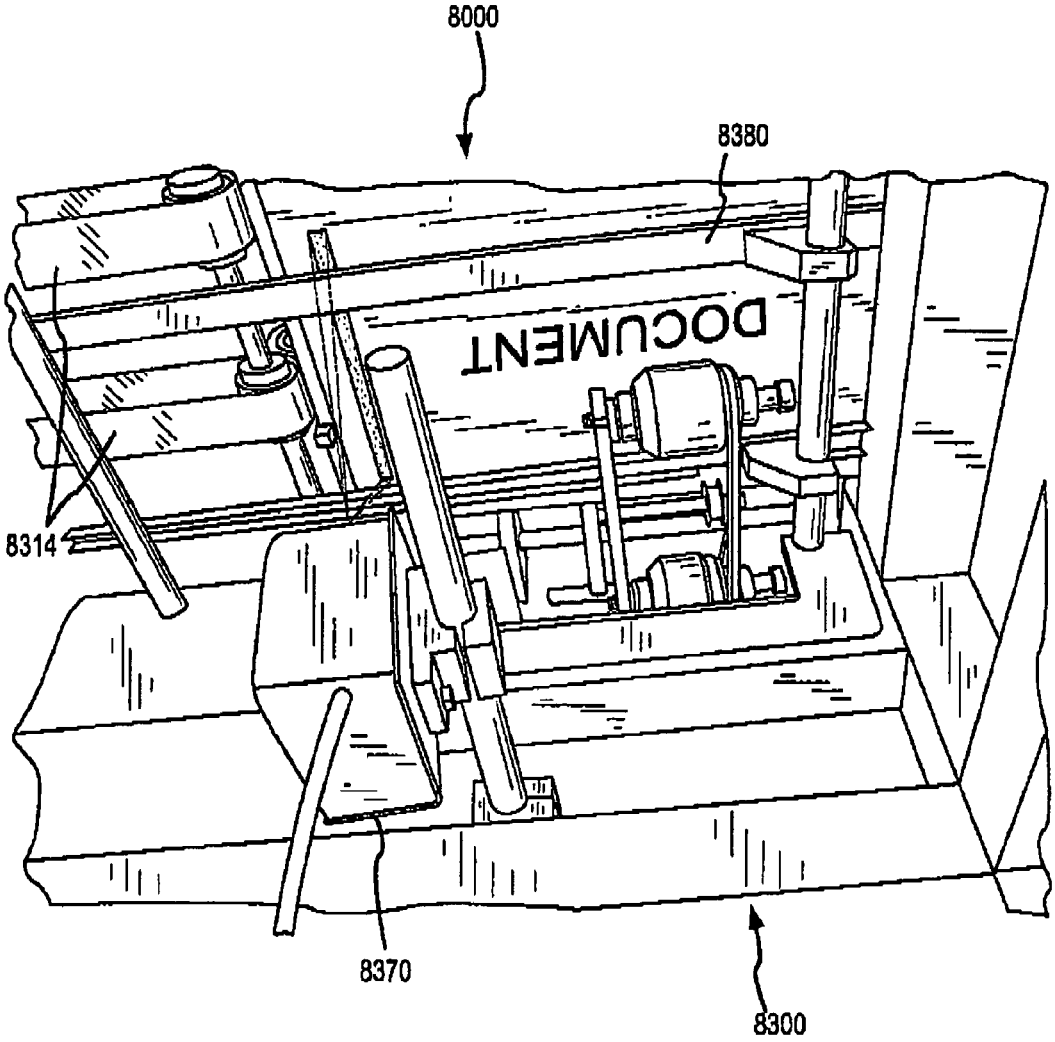
FIG. 8 illustrates a perspective view of a sheet processing system according to one embodiment of the present invention.

As the sheet is conveyed to alignment mechanism 4300, it can be advanced over a sheet information sensor (see FIG. 8). The sheet information sensor can read a bar code on the sheet, and this information can be passed to computer 4500. In some embodiments, if the bar code indicates a rogue sheet, an alarm can be produced and any further processing stopped. The alarm may be audible, visual, or a combination of both. For example, a light may be lit if the sheet is out of order or otherwise inappropriate. In some embodiments, the detection of a sheet that is out of sequence will cause the controller 4500 to discontinue operation of upper feeder 4202, lower feeder 4204, alignment mechanism 4300, or other system components.

As noted above, first and second sheets can be matched by selective processing of the sheets. Often, once the initial first and second sheets have been processed, the procedure is repeated so that a continuous stream of matched first and second sheets are placed onto accumulator 4400 and then advanced for further processing.

Figure 5:
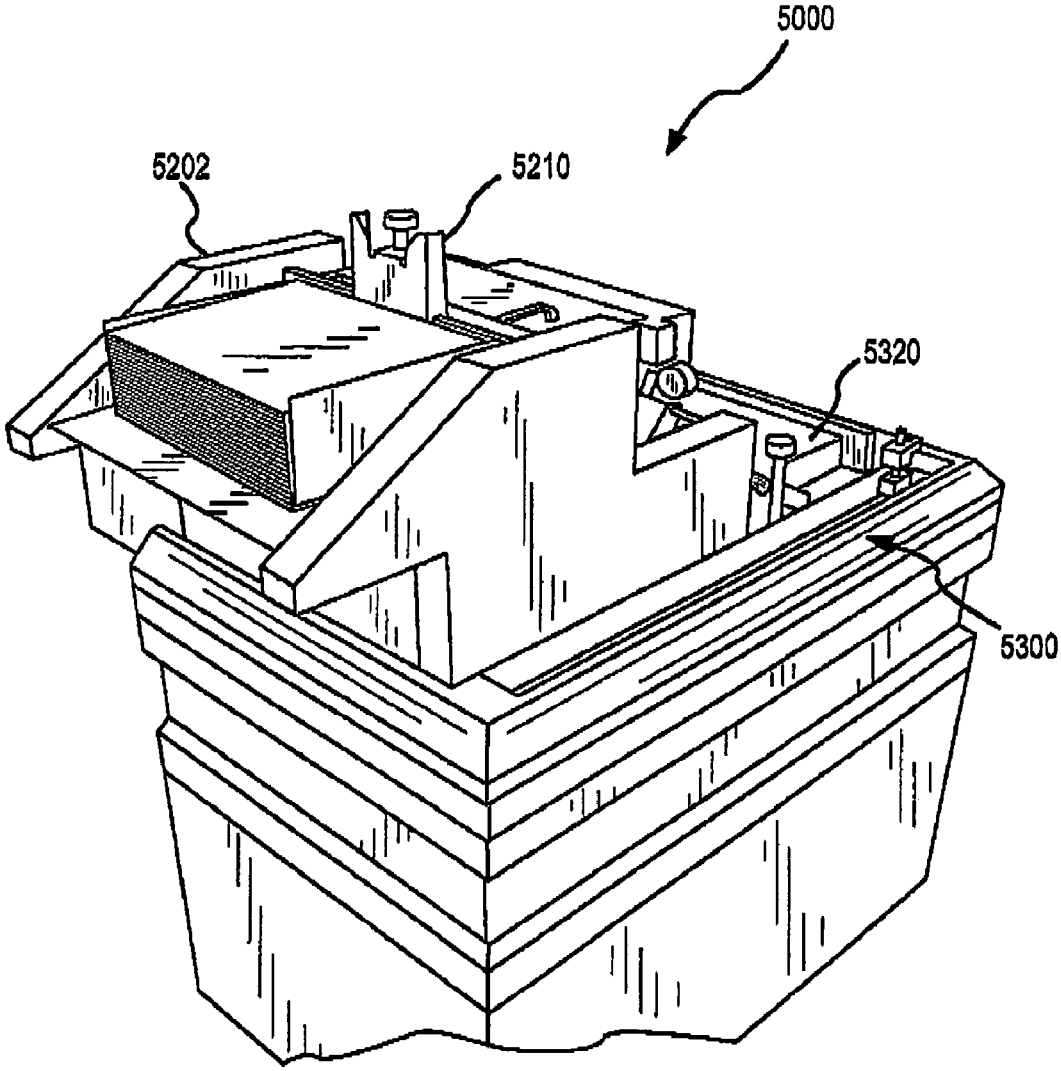
FIG. 5 shows a perspective view of a sheet processing system according to one embodiment of the present invention.
Figure 6:
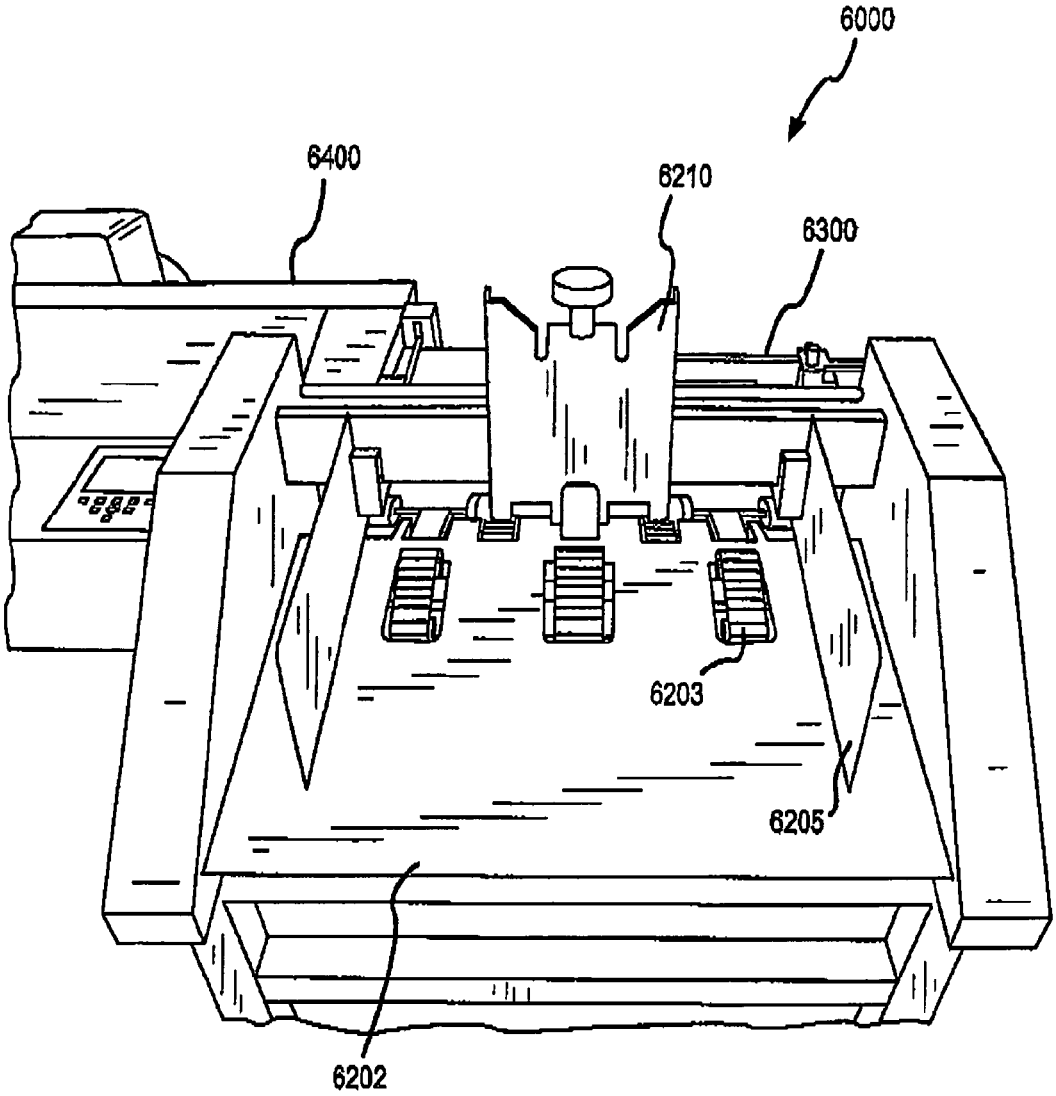
FIG. 6 shows a perspective view of a sheet processing system according to one embodiment of the present invention.

FIG. 5 shows a partial back perspective view of a sheet processing system 5000 according to one embodiment of the present invention. System 5000 includes upper feeder tray 5202, upper advancing mechanism 5210, alignment mechanism 5300, and second advancing mechanism 5320. FIG. 6 shows a sheet processing system 6000 according to one embodiment of the present invention. System 6000 includes upper feeder tray 6202, upper advancing mechanism 6210, upper advancing mechanism belts 6203, alignment mechanism 6300, and accumulator 6400. System 6000 may also include upper rails 6205 to guide advancing sheets or otherwise hold a sheet stack in place during operation.

Figure 7:
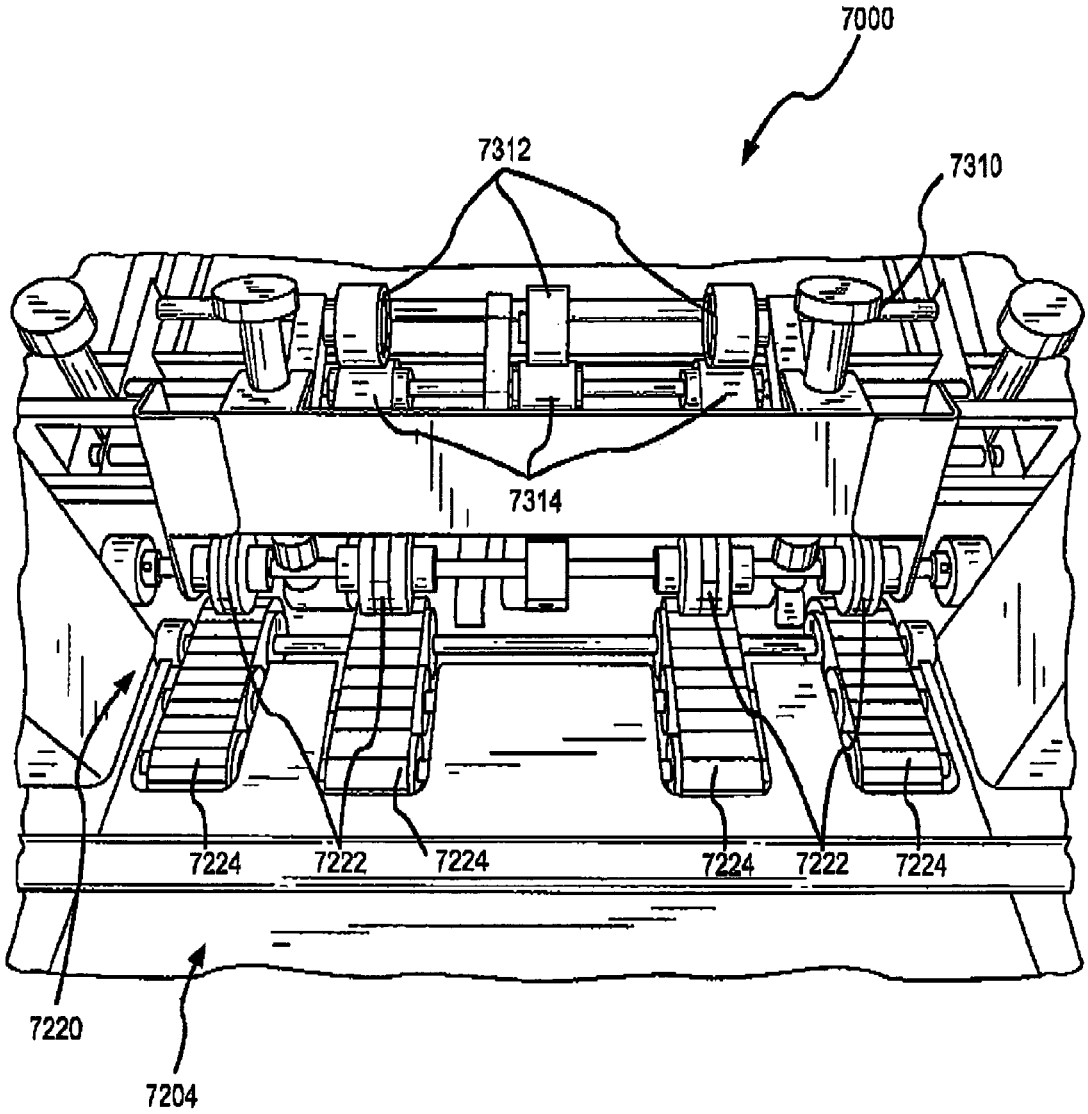
FIG. 7 shows a perspective view of a sheet processing system according to one embodiment of the present invention.

FIG. 7 shows a partial back top perspective view of a sheet processing system 7000 according to one embodiment of the present invention. System 7000 includes lower feeder tray 7204, lower advancing mechanism 7220, and first advancing mechanism 7310. Lower advancing mechanism 7220 includes lower rollers 7222 and lower belts 7224. First advancing mechanism 7310 includes first rollers 7312 and first belts 7314.

FIG. 8 shows a partial bottom view of a sheet processing system 8000 according to one embodiment of the present invention. System 8000 includes alignment mechanism 8300, first advancing mechanism belts 8314, sheet information sensor 8370, and one or more sheet supports 8380. As noted above, sheet information sensor 8370 can be adjusted in any of a variety of positions and orientations, depending on the needs of the needs of the operator. The position, location, and orientation of sensor 8370 can be adjusted in order to accurately read bar codes or other indicia from sheets as they are advanced through system 8000. For example, sensor 8370 may be disposed near a first end of the sheet, or toward an opposite end of the sheet. Sensor 8370 may be situated over the sheet, or under the sheet. Further, sensor may be angularly oriented relative to the sheet in any desired position, in order to read, for example, horizontally or vertically oriented indicia. In the embodiment depicted in FIG. 8, sheet information sensor 8370 is disposed beneath the sheet. Such adjustability of information sensor 8370 can provide convenient advantages over other known systems, where an operator is required to adjust elements of a feeder system in order to achieve the desired positioning of a sheet with respect to a sensor, and in particular over those systems where feeder elements cannot be adjusted so as to position the sheet as desired.

Figure 9:
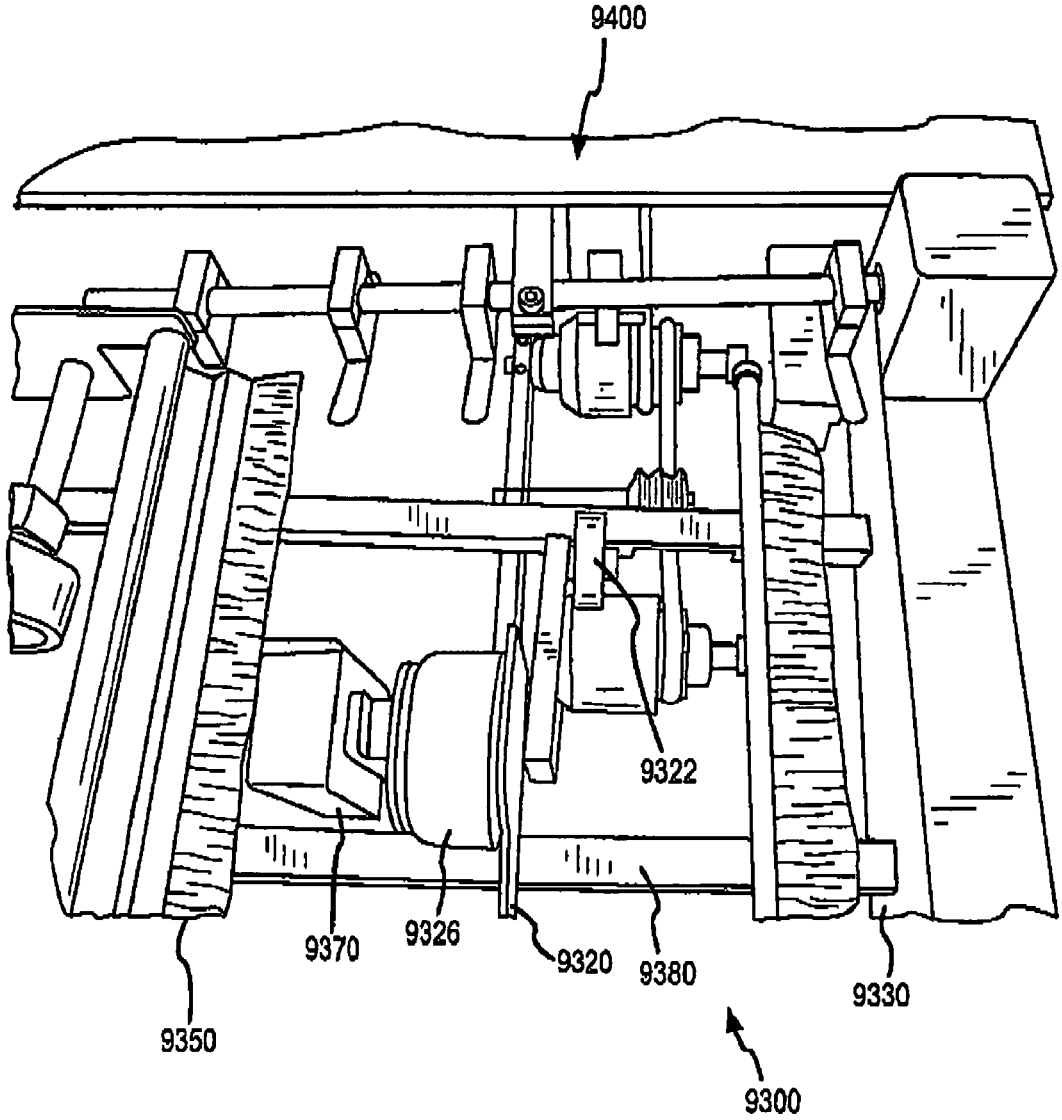
FIG. 9 illustrates a perspective view of a sheet processing system according to one embodiment of the present invention.

FIG. 9 shows a partial top view of a sheet processing system 9000 according to one embodiment of the present invention. System 9000 can include an alignment mechanism 9300 and an accumulator. Alignment mechanism 9300 can include a second advancing mechanism 9320 which has a second roller 9322 and a rotary solenoid 9326. Alignment mechanism 9300 can also include an alignment member 9330, one or more brushes 9350, a sheet information sensor 9370, and one or more sheet supports 9380.

In some embodiments, sheet information sensor 9370 includes a laser scanner or other type of light sensor. For example, a laser scanner can include a laser beam as a light source. A reciprocating mirror or rotating prism can scan the beam back and forth across the bar code. The scanner typically includes a photo diode to measure the intensity of light reflected back from the bar code. The scanner can then provide electrical output to a decoder that corresponds to the bars and spaces of the bar code, and the interpreted signals can be transmitted to the system controller. The present invention may incorporate any of a variety of commercially available sensors, such as those manufactured by Microscan®.

Figure 10:
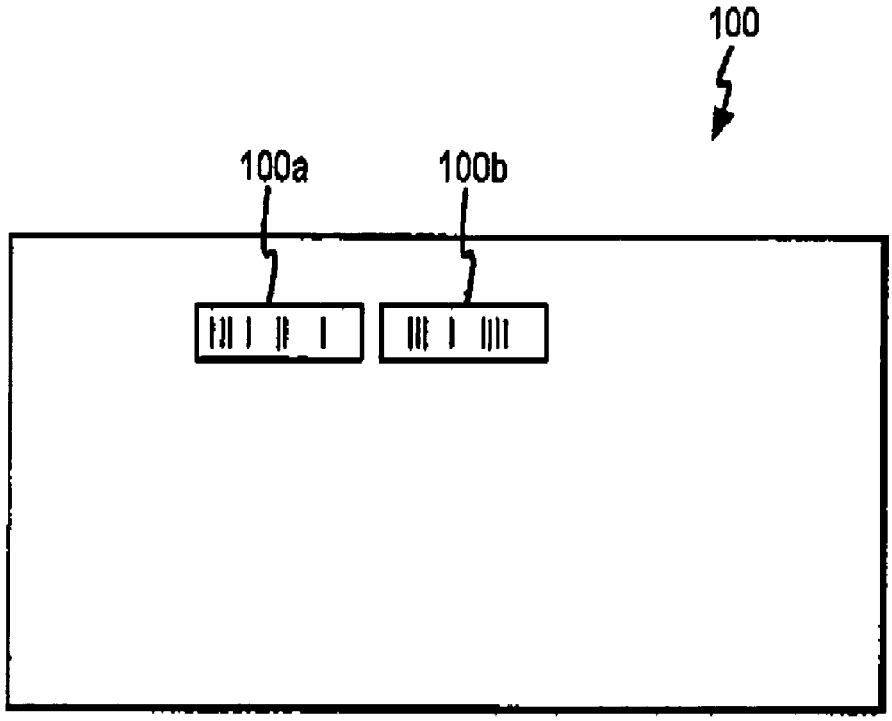
FIG. 10 illustrates a bar coded sheet according to one embodiment of the present invention.

FIG. 10 shows a sheet 100 having a bar code according to one embodiment of the present invention. Bar code can include a first bar code element 100*a*, such as a set number identifier, that indicates the number of sheets in a particular set. For example, first bar code element 100*a* may indicate that there are three (3) sheets in a set. In some embodiments, a particular set can be associated with an individual person or a corporate customer. The bar code can also include a second bar code element 100*b*, such as a sequence number identifier, that indicates the individual member number of a particular set. For example, second bar code element 100*b* may indicate that the particular sheet is sheet number one (1) of a set of three (3) associated sheets.

Figure 11:
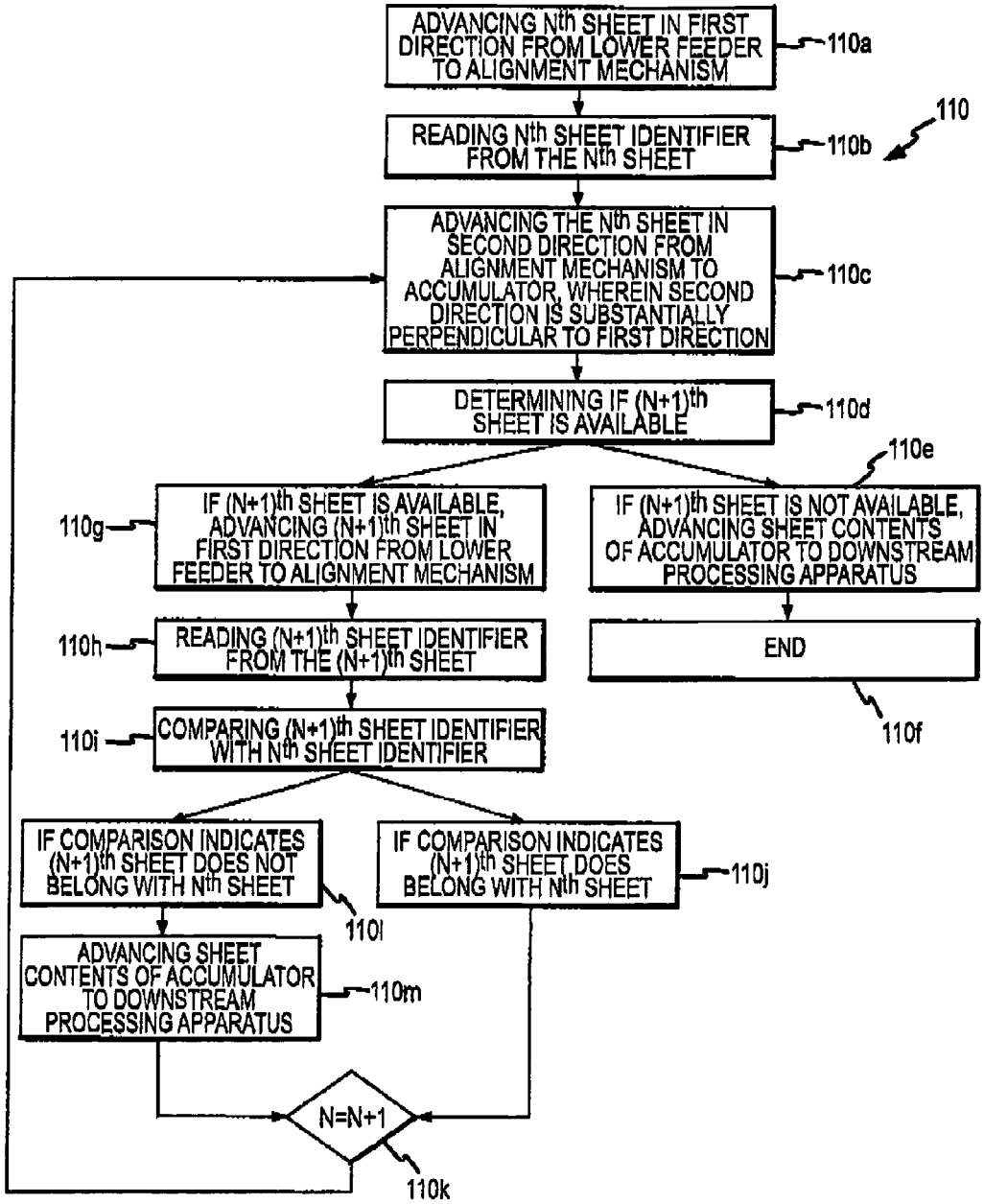
FIG. 11 provides a schematic flow chart of a sheet processing method according to one embodiment of the present invention.

FIG. 11 provides a flow chart 110 illustrating a sheet processing method according to one embodiment of the present invention. The method can include advancing an $N^{th}$ sheet in a first direction from a lower feeder to an alignment mechanism (step 110*a*) and reading the $N^{th}$ sheet identifier from the $N^{th}$ sheet (step 110*b*). Often, the method will include aligning the sheet with an alignment plate or member of the alignment mechanism. The method can include verifying that the sheet is fully advanced in the alignment mechanism, and is aligned in the mechanism. The method can further include verifying that only a single sheet is present in the alignment mechanism. In some embodiments, the $N^{th}$ sheet can be advanced from the bottom of a stack of sheets.

Subsequently, the method may include advancing the $N^{th}$ sheet in a second direction from the alignment mechanism toward an accumulator (step 110*c*). The second direction may be at a specific angle as compared to the first direction. For example, the second direction may be substantially perpendicular to the first direction. After advancing the $N^{th}$ sheet to the accumulator, the method may include determining if an $(N+1)^{th}$ sheet is available (step 110*d*).

If the $(N+1)^{th}$ sheet is not available, the method may include advancing the sheet contents of the accumulator to a downstream processing apparatus (step 11*e*) and ending the procedure (step 110*f*). If $(N+1)^{th}$ is available, the method may include advancing the $(N+1)^{th}$ in the first direction from the lower feeder to the alignment mechanism (step 110*g*), reading the $(N+1)^{th}$ identifier from the $(N+1)^{th}$ sheet (step 110*h*), and comparing the $(N+1)^{th}$ sheet identifier with the $N^{th}$ sheet identifier (step 110*i*).

In the comparison indicates that the $(N+1)^{th}$ sheet does belong with the $N^{th}$ sheet (step 110*j*), the method may include incrementing N by one by setting N=N+1 (step 110*k*), and returning to step 110*c*. If the comparison indicates that the $(N+1)^{th}$ sheet does not belong with the $N^{th}$ sheet (step 1101), the method may include advancing the sheet contents of the accumulator to a downstream processing apparatus (step 110*m*), incrementing N by one by setting N=N+1 (step 110*k*), and returning to step 110*c*.

Figure 12:
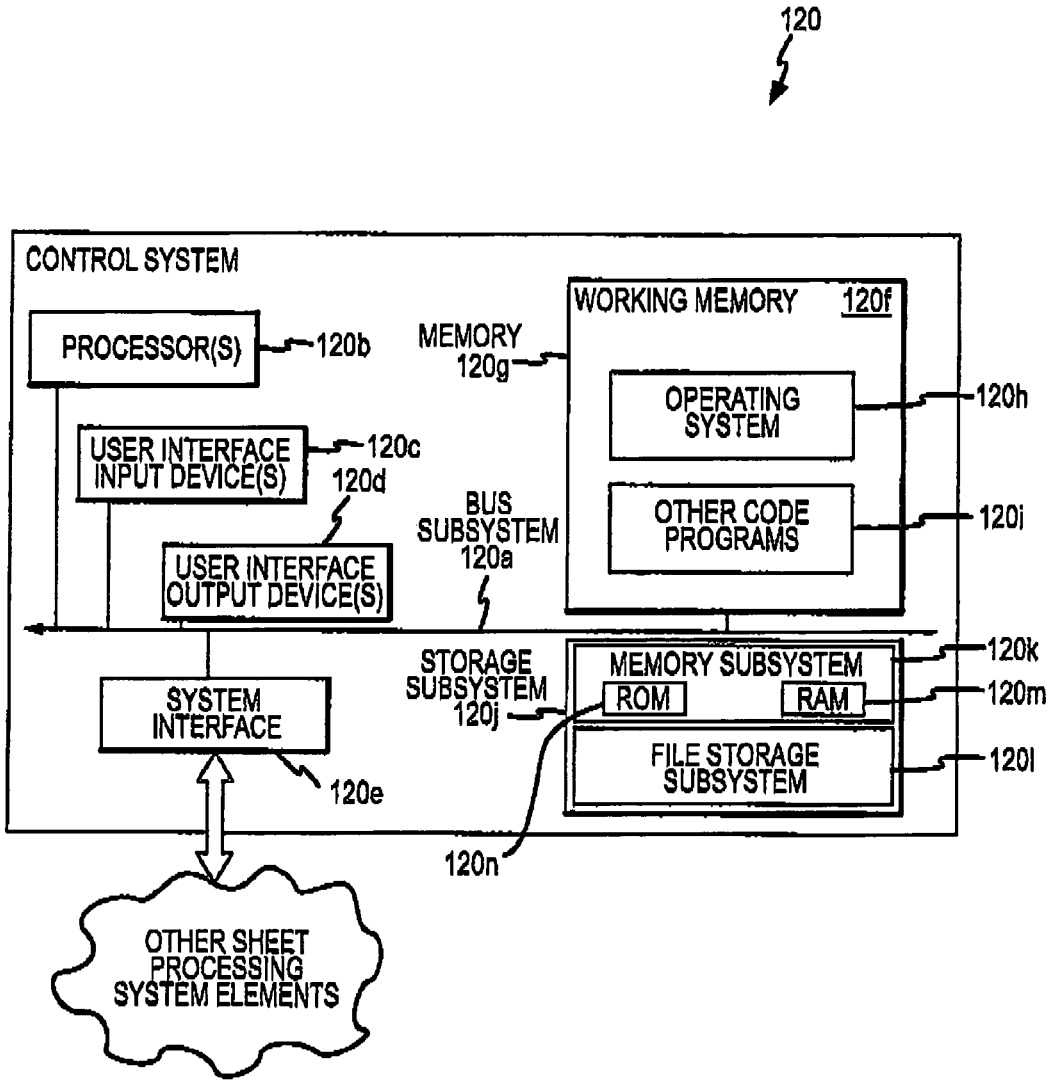
FIG. 12 provides a block diagram of an exemplary computer system according to one embodiment of the present invention.

FIG. 12 is a simplified block diagram of an exemplary computer system 120 according to one embodiment of the present invention. System 120 is shown comprised of hardware elements that are electrically coupled via a bus 120*a*, including one or more processors 120*b*, one or more input devices 120*c* such as user interface input devices, one or more output devices 120*d* such as user interface output devices, and an interface subsystem 120*e*. In some embodiments system 120 also comprises software elements, shown as being currently located within working memory 120*f* of memory 120*g*, including an operating system 120*h* and other code 120*i*, such as a program designed to implement methods of the invention.

Likewise, in some embodiments system 120 may also include a storage subsystem 120*j* that can store the basic programming and data constructs that provide the functionality of the various embodiments of the present invention. For example, software modules implementing the functionality of the methods of the present invention, as described herein, may be stored in storage subsystem 120*j*. These software modules are generally executed by the one or more processors 120*b*. In a distributed environment, the software modules may be stored on a plurality of computer systems and executed by processors of the plurality of computer systems. Storage subsystem 120*j* can include memory subsystem 120*k* and file storage subsystem 1201. Memory subsystem 120*k* may include a number of memories including a main random access memory (RAM) 120*m* for storage of instructions and data during program execution and a read only memory (ROM) 120*n* in which fixed instructions are stored. File storage subsystem 1201 can provide persistent (non-volatile) storage for program and data files, and may include tangible storage media which may optionally embody patient, provider, payer, or other healthcare or financial data. File storage subsystem 1201 may include a hard disk drive, a floppy disk drive along with associated removable media, a Compact Digital Read Only Memory (CD-ROM) drive, an optical drive, DVD, CD-R, CD-RW, solid-state removable memory, other removable media cartridges or disks, and the like. One or more of the drives may be located at remote locations on other connected computers at other sites coupled to system 120. The modules implementing the functionality of the present invention may be stored by file storage subsystem 1201. In some embodiments, the software or code will provide protocol to allow the system 120 to communication with or control other components of the sheet processing system, such as the upper advancing mechanism, the lower advancing mechanism, the first advancing mechanism, the second advancing mechanism, the rotary solenoid, and various sensors of the system.

The system may be configured to include or execute a computer program product for processing a series of sheets. In one embodiment, the program product can include code for advancing a first sheet in a first direction to an alignment mechanism, code for reading a first identification code of the first sheet; code for advancing the first sheet in a second direction to an accumulator, wherein the second direction is substantially perpendicular to the first direction, code for advancing a second sheet in the first direction to the alignment mechanism, code for reading a second identification code of the second sheet, code for advancing the second sheet in the second direction to match with the first sheet in the accumulator if the second identification code corresponds with the first identification code, and a computer-readable medium for storing the codes.

It is appreciated that system 120 can be configured to carry out various methods of the present invention. For example, processor component or module 120*b* can be a microprocessor control module configured to receive signals from input device or module 120*c*, and transmit signals to output device or module 120*d* and/or interface device or module 120*e*. Each of the devices or modules of the present invention can include software modules on a computer readable medium that is processed by a processor, hardware modules, or any combination thereof. Any of a variety of commonly used platforms, such as Windows, Macintosh, and Unix, along with any of a variety of commonly used programming languages, may be used to implement the present invention.

User interface input devices 120*c* may include, for example, a touchpad, a keyboard, pointing devices such as a mouse, a trackball, a graphics tablet, a scanner, a joystick, a touchscreen incorporated into a display, audio input devices such as voice recognition systems, microphones, and other types of input devices. User input devices 120*c* may also download a computer executable code from a tangible storage media or from a communication network, the code embodying any of the methods of the present invention. It will be appreciated that system software may be updated from time to time and downloaded to the system as appropriate. In general, use of the term "input device" is intended to include a variety of conventional and proprietary devices and ways to input information into system 120.

User interface output devices 120*c* may include, for example, a display subsystem, a printer, a fax machine, or non-visual displays such as audio output devices. The display subsystem may be a cathode ray tube (CRT), a flat-panel device such as a liquid crystal display (LCD), a projection device, or the like. The display subsystem may also provide a non-visual display such as via audio output devices. In general, use of the term "output device" is intended to include a variety of conventional and proprietary devices and ways to output information from computer system 120 to a user.

Bus subsystem 120*a* provides a mechanism for letting the various components and subsystems of system 120 communicate with each other as intended. The various subsystems and components of system 120 need not be at the same physical location but may be distributed at various locations within a distributed network. Although bus subsystem 120*a* is shown schematically as a single bus, alternate embodiments of the bus subsystem may utilize multiple busses.

It will be apparent to those skilled in the art that substantial variations may be used in accordance with specific requirements. For example, customized hardware might also be used and/or particular elements might be implemented in hardware, software (including portable software, such as applets), or both. Further, connection to other computing devices such as network input/output devices may be employed. System 120 itself can be of varying types including a computer terminal, a personal computer, a portable computer, a workstation, a network computer, or any other data processing system. Due to the ever-changing nature of computers and networks, the description of system 120 depicted in FIG. 12 is intended only as a specific example for purposes of illustrating one embodiment of the present invention. Many other configurations of system 120 are possible having more or less components than the computer system depicted in FIG. 12. Relatedly, any of the hardware and software components discusses above can be integrated with or configured to interface with other components of the sheet processing system.

What is claimed is:

1. A method for processing a series of sheets, the method comprising:

advancing, using an upper advancing mechanism, a batch of sheets from an upper feeder tray directly to a lower feeder tray positioned below and adjacent the upper feeder tray;

advancing a first sheet of the series of sheets from the lower feeder tray in a first direction to an alignment mechanism;

reading a first identification code from the first sheet;

advancing the first sheet in a second direction to an accumulator, wherein the second direction is substantially perpendicular to the first direction;

advancing a second sheet of the series of sheets from the lower feeder tray in the first direction to the alignment mechanism;

reading a second identification code from the second sheet; and comparing the first identification code read from the first sheet with the second identification code read from the second sheet.

2. The method of claim 1, further comprising advancing the second sheet in the second direction to match with the first sheet in the accumulator, if the second identification code corresponds with the first identification code.

3. The method of claim 2, wherein advancing each sheet to the alignment mechanism comprises aligning the sheet with an alignment plate of the alignment mechanism.

4. The method of claim 2, wherein advancing each sheet to the alignment mechanism comprises advancing a bottom sheet of a sheet stack to the alignment mechanism.

5. The method of claim 2, wherein advancing each sheet to the alignment mechanism comprises verifying that a single sheet at a time is advanced to the alignment mechanism.

6. The method of claim 2, wherein advancing each sheet to the alignment mechanism comprises verifying that each sheet is fully advanced to the alignment mechanism and is aligned within the alignment mechanism.

7. The method of claim 2, wherein advancing each sheet to the accumulator comprises contacting each sheet with a friction wheel.

8. The method of claim 7, wherein the friction wheel is in operative association with a rotary solenoid.

9. The method of claim 1, wherein the identification code of each sheet comprises a bar code.

10. The method of claim 1, wherein the identification code of each sheet comprises a set number identifier and a sequence number identifier.

11. The method of claim 1, wherein reading the identification code comprises scanning the identification code with a laser scanner.

12. A system for processing a series of sheets, the system comprising:

an alignment mechanism comprising an alignment plate;

an upper feeder tray;

a lower feeder tray positioned below and adjacent the upper feeder tray;

an upper advancing mechanism that is configured to advance a batch of sheets from the upper feeder tray directly to the lower feeder tray;

a first advancing mechanism that is configured to individually advance each sheet of the series of sheets in a first direction from the lower feeder tray to the alignment mechanism;

a second advancing mechanism that is configured to individually advance each sheet of the series of sheets in a second direction from the alignment mechanism to an accumulator, wherein the second direction is substantially perpendicular to the first direction;

a sensor that is configured to read an identification code from each sheet of the series of sheets; and a processor configured to compare a first identification code read from a first sheet of the series of sheets with a second identification code read from a second sheet of the series of sheets and to control operation of the first and second advancing mechanisms based on sensor readings of the identification codes.

13. The system of claim 12, wherein the alignment mechanism comprises an alignment plate.

14. The system of claim 12, further comprising a count sensor configured to verify that a single sheet at a time is advanced to the alignment mechanism.

15. The system of claim 12, further comprising an orientation sensor configured to verify that each sheet is fully advanced to the alignment mechanism and is aligned within the alignment mechanism.

16. The system of claim 12, wherein the second advancing mechanism comprises a friction wheel adapted to contact a sheet disposed in the alignment mechanism upon instructions from the processor.

17. The system of claim 16, wherein the friction wheel is in operative association with a rotary solenoid.

18. The system of claim 12, wherein the sensor comprises a laser scanner.

19. A computer program product for processing a series of sheets, the program product comprising:

code for advancing a batch of sheets from an upper feeder tray directly to a lower feeder tray positioned below and adjacent the upper feeder tray;

code for advancing a first sheet of the series of sheets from the lower feeder tray in a first direction to an alignment mechanism;

code for reading a first identification code from the first sheet;

code for advancing the first sheet in a second direction to an accumulator, wherein the second direction is substantially perpendicular to the first direction;

code for advancing a second sheet of the series of sheets from the lower feeder tray in the first direction to the alignment mechanism;

code for reading a second identification code from the second sheet;

code for comparing the first identification code read from the first sheet with the second identification code read from the second sheet; and a computer-readable medium for storing the codes.

20. The computer program product of claim 19, further comprising code for advancing the second sheet in the second direction to match with the first sheet in the accumulator, if the second identification code corresponds with the first identification code.

* * * * *